United States Patent [19]

Davis

[11] 4,087,121

[45] May 2, 1978

[54] DEAD BOLT LOCK

[76] Inventor: Thomas R. Davis, 5115 Shady Oak La., Friendswood, Tex. 77546

[21] Appl. No.: 777,550

[22] Filed: Mar. 14, 1977

[51] Int. Cl.[2] ..... E05B 15/02

[52] U.S. Cl. ..... 292/139; 292/153; 292/341.17

[58] Field of Search ..... 292/18, 30, 119, 127, 292/135, 139, 153, 341.15, 341.16, 341.17; 70/102, 103, 104, 131

[56] References Cited

U.S. PATENT DOCUMENTS

| | | | |
|---|---|---|---|
| 1,398,636 | 11/1921 | Forlander | 292/341.17 X |
| 1,493,526 | 5/1924 | Freysinger | 292/341.17 X |
| 1,673,468 | 6/1928 | Palinkas | 70/131 X |
| 1,964,157 | 6/1934 | Holtzman | 70/131 |
| 2,446,113 | 7/1948 | Spiller | 292/30 |
| 2,575,465 | 11/1951 | Patton | 292/341.17 X |
| 3,600,021 | 8/1971 | Hawkins | 292/341.17 X |
| 3,699,788 | 10/1972 | Gerlach et al. | 292/139 X |
| 3,702,549 | 11/1972 | Solovieff et al. | 292/139 X |

FOREIGN PATENT DOCUMENTS

| | | | |
|---|---|---|---|
| 109,373 | 4/1928 | Austria | 292/153 |
| 79,920 | 1/1920 | Austria | 70/131 |

*Primary Examiner*—Roy D. Frazier
*Assistant Examiner*—Thomas J. Holko
*Attorney, Agent, or Firm*—Ranseler O. Wyatt

[57] ABSTRACT

A dead bolt lock for doors, and the like, having an axial shaft extendable from the bolt and a bolt catch mounted in the door jamb adapted to be actuated by said shaft when the bolt is moved into extended position, and to engage and lock said bolt, until said shaft is retracted.

2 Claims, 3 Drawing Figures

DEAD BOLT LOCK

BACKGROUND OF THE INVENTION

In deadbolt locks, such as are commonly used on doors, forced entrance is accomplished by spreading the door frame, thus moving the bolt out of engagement with the bolt receiving chamber mounted in the door jamb. It is an object of this invention to provide means to move the bolt into locking position and to lock same in said position so that the bolt may not be released from the bolt receiving chamber in the door jamb except by actuation of the bolt retracting mechanism.

SUMMARY OF THE INVENTION

A dead bolt lock having a bolt movable into a bolt receiving chamber mounted in the door jamb, and an axial shaft in said bolt movable outwardly from said bolt into engagement with a bolt receiving means which will be thereby actuated to move into locking position with said bolt, and which will be relieved only by retraction of said shaft from said bolt engaging means.

DESCRIPTION OF THE PREFERRED EMBODIMENTS

Figure 1:
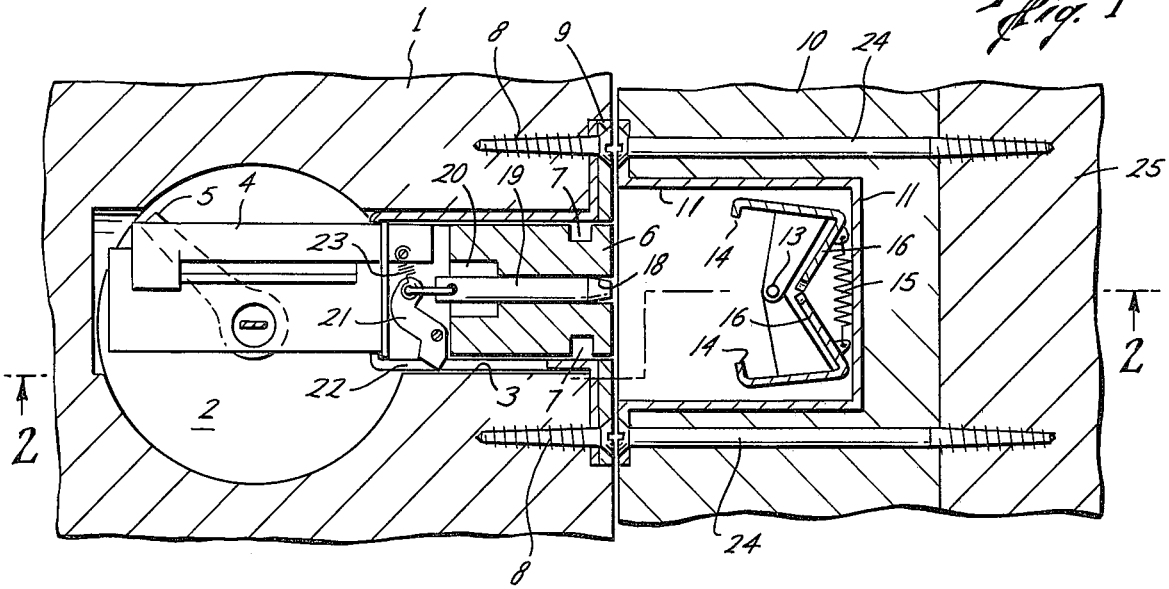
FIG. 1 is a side elevational view, in cross section, of the device in retracted position.
Figure 2:
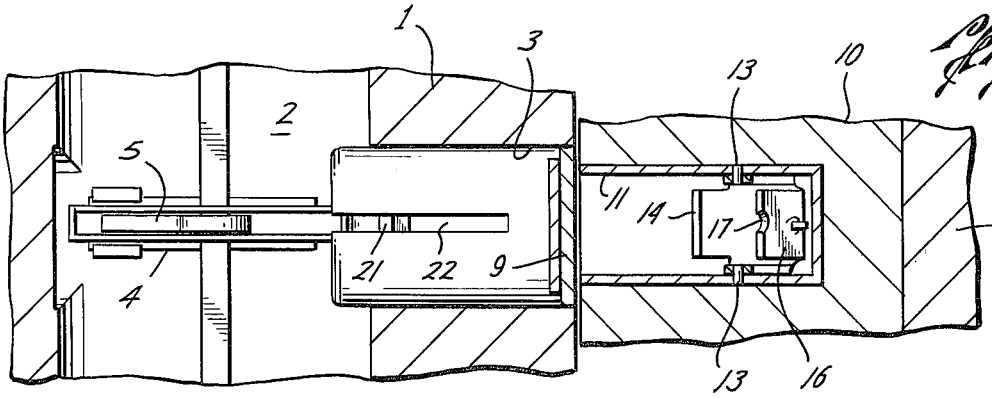
FIG. 2 is a bottom view, in cross section, taken on the line 2—2 of FIG. 1.
Figure 3:
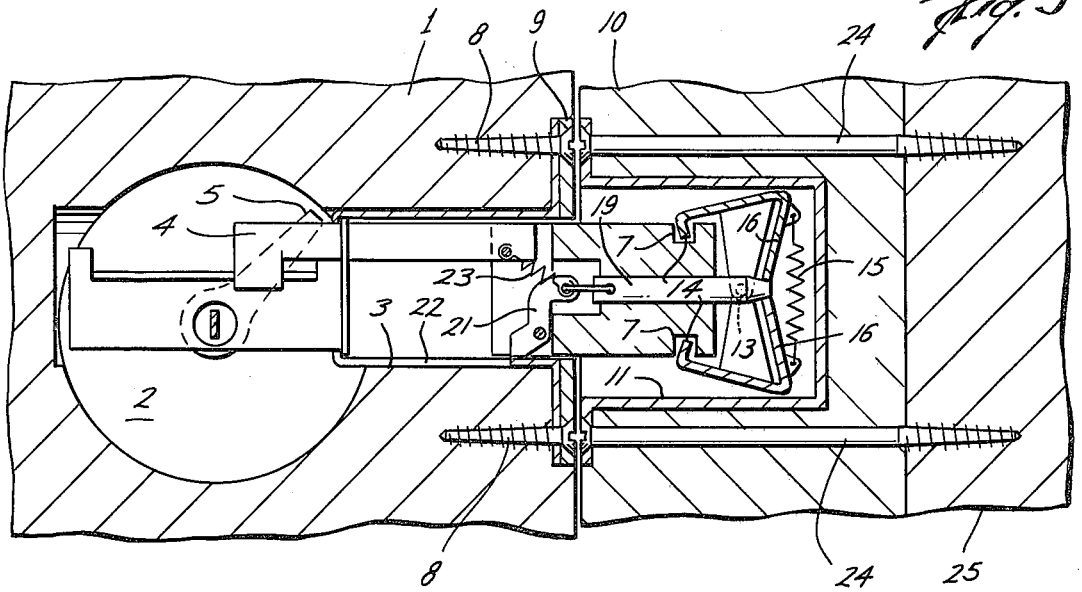
FIG. 3 is a side elevational view, in cross section, of the device in locked position.

In the drawings, the numeral 1 designates a door having a lever operated lock 2 and a bolt barrel 3. The bolt actuating shaft 4, which is extended and retracted by means of the lever 5, the bolt 6 being attached to the actuating shaft 4, at one end, and having slots 7, 7 in the exterior surface thereof. The barrel 3 is secured in the door edge by means of the screws 8, 8 which hold the plate 9 against the flange of the barrel 3.

Seated in the door jamb 10 is the bolt receiving chamber 11 and pivotally mounted therein, by means of the pins 13, 13, are the jaws 14, 14, which are maintained normally in inactive position by means of the spring 15. Each jaw 14 has the extended margin overturned to form an engaging edge to be received by the slots 7, 7 of the bolt 6. Each jaw has the inwardly directed back wall 16, 16 in which the semi-circular passageway 17 is formed.

The bolt 3 has an axial passageway 18 therethrough in which the shaft 19, having its extended end tapered, is mounted. This passageway 18 is enlarged at 20 to receive one end of the connecting link 21. The link 21 is loosely connected to the shaft 19, and is pivotally mounted in the barrel 3, with one end projecting through the longitudinal slot 22 and a spring 23, secured to the other end of the link 21 at one end and at its other end to the actuating shaft 4.

Screws as 24, 24 anchor the receiving chamber 11 to the door jamb, and pass through the door jamb into the building frame 25.

As the lever 5 is moved, the shaft 4 moves the bolt 6 into the receiving chamber 11, and as the bolt 6 reaches the end of its travel, the link 21, passing through the slot 22, will reach the end of the slot 22 and will be pivoted, driving the shaft 19 outwardly from the end of the bolt 6, and the tapered end of the shaft 19 will enter the two semi circular passageways 17, 17 and will contact the back walls 16, 16 of the jaws 14, 14, and will move the jaws into engagement in the slots 7, 7 and will lock the jaws against disengagement, the shaft 19 in the passageways 17, 17, preventing the jaws from being moved out of engagement with the slots formed in the exterior surface of the bolt 6. When the lever 5 is moved back to unlocked position, the shaft 7 will first move out of the passageways 17, 17 through pressure from the spring 23, releasing the jaws 14, 14 and the spring 15 will maintain the jaws in retracted position until the shaft 19 is again moved into engagement therewith.

What I claim is:

1. In a dead bolt lock, a retractable bolt manually movable into and out of extended position, an axial shaft extending longitudinally through said retractable bolt and movable therewith, locking means movable into engagement with said retractable bolt, means for manually moving said shaft outwardly from said retractable bolt after said retractable bolt reaches its extended position, and into contact with said locking means and into engagement therewith, said retractable bolt comprising a movable member connected at one end to an actuating means, and having notches formed in the exterior surface adjacent the other end, a barrel in which said bolt reciprocates, said barrel having a longitudinal slot therein, a link pivotally mounted in said barrel having one end extended into said slot, and the other end loosely connected to said axial shaft and positioned to be moved against the end of said axial shaft and move said shaft outwardly from said bolt.

2. In a dead bolt lock, a retractable bolt manually movable into and out of extended position, an axial shaft extending longitudinally through said retractable bolt and movable therewith, locking means movable into engagement with said retractable bolt, means for manually moving said shaft outwardly from said retractable bolt after said retractable bolt reaches its extended position, and into contact with said locking means and into engagement with said locking means, said locking means comprising a pair of pivotally mounted jaws having yieldable means for normally maintaining said jaws in open position, and said axial shaft being positioned to contact said jaws when moved into extended position to move said jaws into bolt engaging position, a semi-circular passageway in each of said jaws arranged in juxtaposition to form a circular passageway and the end of said axial shaft being tapered and positioned to enter said circular passageway, contacting said jaws and moving same into engaged position.

* * * * *